United States Patent [19]

Eakes

[11] 4,211,154

[45] Jul. 8, 1980

[54] APPARATUS FOR IMPROVING THE COLLECTION OF GASES INTO A SUCTION ORIFICE

[76] Inventor: Marion L. Eakes, 2618 W. Vandalia Rd., Greensboro, N.C. 27407

[21] Appl. No.: 943,791

[22] Filed: Sep. 20, 1978

[51] Int. Cl.[2] ..... F21C 15/08; F23J 11/00

[52] U.S. Cl. ..... 98/115 LH; 55/DIG. 36; 126/299 D

[58] Field of Search ..... 98/36, 115 R, 115 LH; 126/299 D; 55/DIG. 36

[56] References Cited

U.S. PATENT DOCUMENTS

| | | | |
|---|---|---|---|
| 2,704,505 | 3/1955 | Morrison | 98/115 LH |
| 2,942,540 | 6/1960 | Lundy | 98/115 R |
| 3,292,525 | 12/1966 | Jensen | 126/299 D |
| 3,303,839 | 2/1967 | Tavan | 126/299 D |
| 3,340,788 | 9/1967 | Landingham et al. | 98/115 LH |
| 3,397,631 | 8/1968 | Simons | 98/36 |
| 3,511,162 | 5/1970 | Truhan | 98/36 |
| 3,814,002 | 6/1974 | Rombach et al. | 98/115 SB |
| 4,011,802 | 5/1977 | Molitor et al. | 98/115 R |
| 4,137,904 | 2/1979 | Dorius | 126/299 D |

*Primary Examiner*—Ronald C. Capossela

[57] ABSTRACT

Gases such as contaminated exhaust or stale air are induced toward a suction orifice by means of an air nozzle spaced from the orifice and pointing generally in the direction thereof to generate a Venturi effect on the gases at considerable distances from the suction orifice. An auxiliary plate extending generally parallel to and spaced slightly from the exposed wall of the air nozzle has one edge thereof positioned at a point farther away from the suction orifice than the outlet of the air nozzle, so that a secondary Venturi is generated and the capture point of the gases being collected is effectively moved further away from the suction orifice thereby improving the collection effect of the orifice.

2 Claims, 3 Drawing Figures

APPARATUS FOR IMPROVING THE COLLECTION OF GASES INTO A SUCTION ORIFICE

BACKGROUND OF THE INVENTION

In a well known method for evacuating an air space of contaminated gases, fumes, or air, it is conventional to provide a hood having a suction orifice connected to a source of negative pressure and in communication with the air space. The negative pressure or suction withdraws air from the space through the suction orifice and with the evacuation of air the contaminated gases and fumes are also withdrawn.

As illustrated in U.S. Pat. No. 4,050,367 to Eakes dated Sept. 27, 1977, it is known to direct air from a nozzle closely adjacent to and directed at the suction orifice to improve the collection of the gases into the orifice by lowering the "capture point" from the area being effected. The principal of the operation of such a device is that the Venturi effect will aid in pulling air up into the suction orifice that might normally be outside the area influenced by the suction orifice. To accomplish good results in such a situation the air nozzle should be fairly close to the suction orifice so that the air is not distributed over too wide an area and is mainly directed as the orifice.

It has become apparent that the further the "capture point" can be located from the suction orifice the more efficient the collection of exhaust gases and the less likely stray gases are to escape from the work chamber above the work table. However, if the air nozzle itself is moved too far from the suction orifice the result is likely to spread the air delivered throughout too wide an area.

SUMMARY OF THE PRESENT INVENTION

Therefore, in accordance with the present invention an auxiliary plate is attached in spaced relation to the wall of the air nozzle and extends substantially parallel thereto. The edge of the auxiliary plate which is furthermost from the intake orifice is thus spaced therefrom a distance greater than the corresponding distance between the intake orifice and the outlet of the air nozzle. Air is induced to enter the slot between the auxiliary plate and the wall of the air nozzle by a secondary Venturi effect from the air nozzle. The slot between the lower edge of the auxiliary plate and the wall of the nozzle then becomes a second suction orifice influencing air at points remote from the first suction orifice. The capture point is thus lowered to a point below the furthermost edge of the auxiliary plate from the suction orifice. The result is that some of the air which might otherwise escape from an area above a work table is brought under the influence of the suction orifice to improve the exhausting of the contaminated gases.

The broad concept of the invention may be utilized in many embodiments as, for example, in the environment of the invention illustrated and described in the aforementioned U.S. Pat. No. 4,050,367. Also, some exhaust hoods are placed above an area in which all sides therearound are opened as in a cooking island such as that illustrated in the U.S. Pat. to Tavan No. 3,303,839. In such a situation, one or more air nozzles might extend upwardly from the table and point toward a suction orifice in the center of the exhaust hood. The auxiliary plate could surround the air nozzle. The capture point of the gases could be lowered to an area substantially right above the cooking surface, which would appreciably improve the collection of the gases before they could escape into the area around the cooking island. In such a case the auxiliary plate may take the shape of a cylindrical or conical shield surrounding the conduit through which the air is pumped to the air nozzle.

Also, the auxiliary plate may take various shapes and forms depending upon the structure and configuration of the exhaust hood and the air nozzle which is directed toward the suction orifice of the hood.

It is therefore an object of the present invention to provide an apparatus for improving the effective collection of fumes and gases from an area beneath an exhaust hood by expanding the area of influence of the suction orifice of the hood.

It is another object of the present invention to provide an apparatus of the type described in which the improvement is directed to an apparatus which, when used with an air nozzle directed toward the suction orifice, develops a second Venturi effect tending to move the capture point further from the suction orifice.

Other objects and a fuller understanding of the invention will be apparent from reading the following detailed description of a preferred embodiment along with the accompanying drawings in which.

DETAILED DESCRIPTION OF PREFERRED EMBODIMENT

Figure 1:
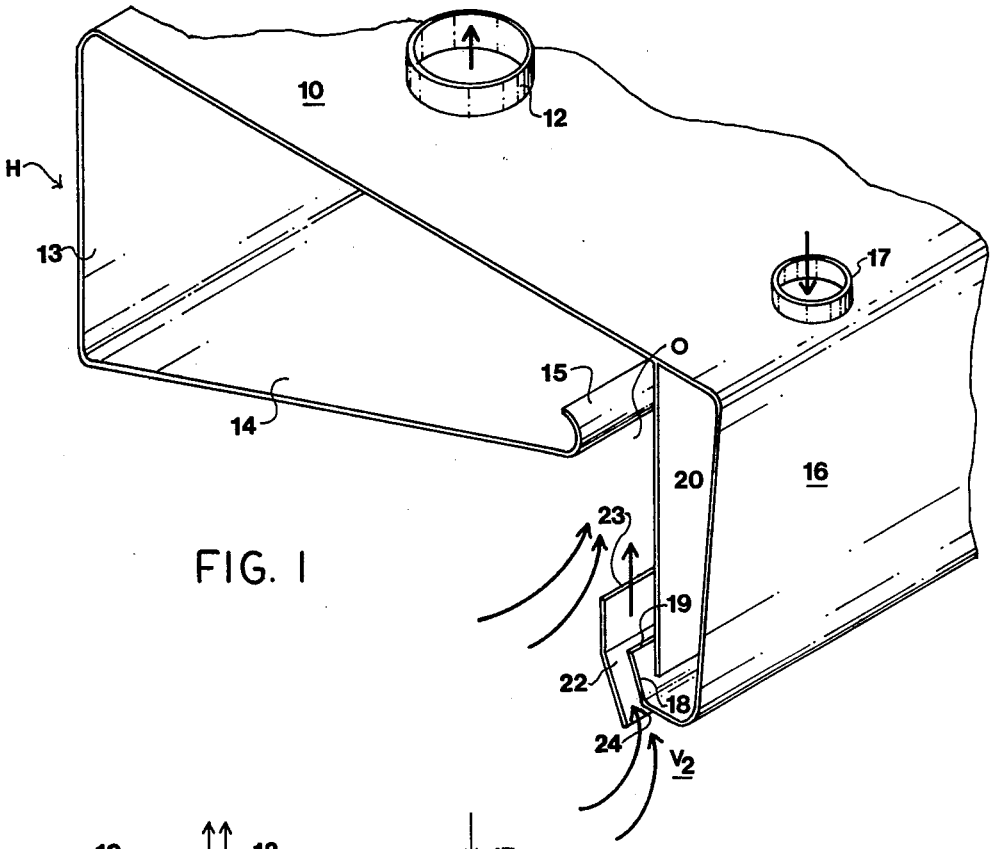
FIG. 1 is a perspective view of an exhaust hood having a capture-point-lowering apparatus mounted thereon and with the upper portion of the nearest side wall removed for the sake of clarity.
Figure 2:
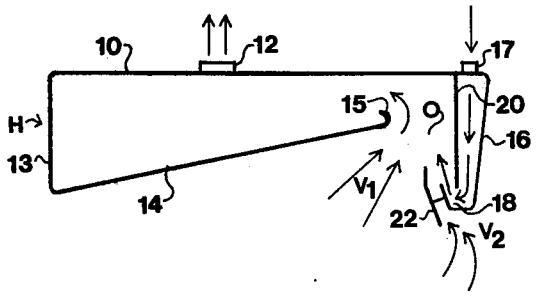
FIG. 2 is a schematic side view of the device illustrated in FIG. 1 showing the areas affected by the air nozzle and auxiliary plate.

Turning now to FIGS. 1 and 2 there is illustrated an exhaust hood H of substantially conventional type which includes a top wall 10 having an opening 12 therein through which suction is applied to the chamber within the hood H by means of a negative pressure source (not shown). A rear wall 13 extends downwardly from the rear edge of top wall 10, and a lower wall 14 slants upwardly and forwardly therefrom to a front rolled edge 15. A front wall 16 depends downwardly from the front edge of upper wall 10 then extends rearwardly and upwardly in a hip 18. A separator wall 20 extends downwardly from the upper wall 10 between the front wall 16 and the rolled edge 15. An inlet 17 is provided for introducing air from a positive pressure source into the space between the front wall 16 and dividing wall 20. This air moves downwardly around the lower edge of divider wall 20 and up through the opening between lip 18 and divider wall 20. This will be hereinafter referred to as the "air nozzle". The suction orifice O is formed by the space between the rolled edge 15 and the divider wall 20. This is the area through which suction is applied to provide an exhaust effect on the area beneath the exhaust hood H.

The aforementioned structure is fairly conventional and illustrated and described in the aforementioned U.S. Pat. No. 4,050,367. So arranged, the air nozzle formed between the lip 18 and the divider wall 20 is continuously directing a jet of air toward the orifice O which improves the collection of the exhaust gases from the air space therebetween and directs them toward the opening O. This nozzle forms a Venturi which in effect lowers the capture point some distance.

In accordance with the present invention, it has been found that upon the addition of an auxiliary plate 22 which extends substantially parallel to the lip 18 and spaced slightly therefrom, the "cature point" will be further lowered to a point beneath the lower edge 24 of auxiliary plate 22 as illustrated in FIG. 2. The air nozzle pulls air between the auxiliary plate 22 and the lip 18 which in actuality forms a secondary Venturi in the area $V_2$. Additionally, the upper edge 23 of plate 22 may be so formed as to position the outlet of air from the air nozzle at any desired location. This upper edge forms the primary Venturi in area $V_1$. Thus air which is escaping from the work area beneath exhaust hood H is less likely to escape the influence of suction orifice O by passing out of the effected area beneath the front wall 16. Considerable latitude may be provided to the designer as far as placement of the outlet of the air nozzle and the lowering of the capture point to a desired position are concerned. One note of explanation is that with a configuration similar to that shown in FIG. 1 the back and sides of the area beneath the exhaust hood would normally be enclosed, such as shown and described in the reference U.S. Pat. No. 4,050,367; the only opening to the atmosphere around the work area being beneath the lower edge of the front wall 16 of the exhaust hood.

Figure 3:
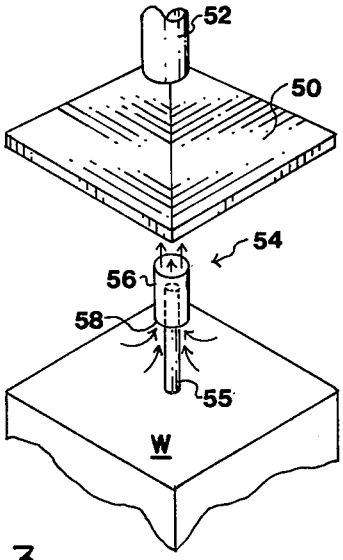
FIG. 3 is a perspective view of an exhaust hood showing a modified arrangement for redirecting a portion of the contaminated gases toward the inlet thereof.

In situations where a different type of construction of work area is utilized such as in the environment illustrated in FIG. 3, it is possible that all sides of the area above the work table W may be open so that there is a possibility of escape of the exhaust gases from all around. In such a situation it would first occur to a skilled artisan that the exhaust hood could be provided with an outer wall air nozzle such as illustrated at element 16 in FIG. 1 all around the exhaust hood. On the other hand, where the exhaust hood 50 is constructed as illustrated in FIG. 3 with a central suction orifice therein, leading through a conduit 52 to a negative suction source, an air nozzle 54 of the type illustrated might be appropriate. In such a situation the air nozzle includes a pipe or conduit 55 through which a positive air flow is induced exiting at the upper end thereof. A cylindrical shield 56 serves as the auxiliary plate which surrounds the air nozzle outlet. So arranged, the air nozzle 54 is still directed toward the suction orifice of the hood 50. However, the shield 56 has a lower edge 58 positioned at a point substantially further from the suction orifice than the outlet of the air nozzle 54, and therefore the capture point is again moved further away from the suction orifice to enlarge the area of captured gases.

In the embodiments shown and illustrated hereinabove it has been assumed that the suction orifice would be at the top of an area and that the air nozzle would be directed in a generally upwardly direction toward the orifice. This is not necessarily the case as the orifice could be in a side wall and the air nozzle could be pointed horizontally toward such a nozzle. The movement of the capture point away from the suction orifice would still have the effect of improving the collection of gases and air from the designated space.

While various preferred embodiments have been shown and described hereinabove, it is apparent that various changes and modifications might be made to the detailed structure shown and described herein without departing from the scope of the invention which is set forth by the claims hereinbelow.

What is claimed is:

1. Apparatus for use with a suction orifice which has a source of negative pressure associated therewith and into which air from an air space is exhausted comprising:

(a) an air having a wall forming an outlet therefor, said nozzle being connected to a source of positive pressure, said air nozzle being spaced from and directed toward said suction orifice for establishing a first venturi to aid in the directing of air from said space into said orifice;

(b) an auxiliary plate extending in substantially parallel, spaced relation to the wall of said air nozzle adjacent the air space affected by the suction orifice;

(c) the edge of said auxiliary plate furthermost from said intake orifice being spaced from said intake orifice a distance greater than the corresponding distance between said intake orifice and the outlet of said air nozzle for establishing a second venturi;

(d) whereby the capture point of air from said air space is effectively moved further from said orifice and less contaminated gases are allowed to escape.

2. In combination with an exhaust hood of the type positioned above a work area for collecting contaminated exhaust gases generated in the work area through an intake orifice having a source of negative pressure downstream therefrom, a device for improving the collection comprising:

(a) an air nozzle having a wall forming an outlet therefor, said nozzle being connected to a source of positive pressure, said nozzle being spaced from and directed toward said intake orifice for establishing a first venturi to aid in directing contaminated gases toward said intake orifice;

(b) an auxiliary plate extending in substantially parallel spaced relation to the wall of said air nozzle with the lower edge of said auxiliary plate being spaced from said intake orifice a distance greater than the distance between said intake orifice and the outlet of said air nozzle for establishing a second venturi below said first venturi;

(c) whereby the capture point of said exhaust gases is moved further from said intake orifice thereby improving collection of gases.

* * * * *